US010549417B2

(12) United States Patent
Ursell et al.

(10) Patent No.: US 10,549,417 B2
(45) Date of Patent: Feb. 4, 2020

(54) SAW HORSE HAVING QUICK RELEASE DEPLOYABLE SUPPORTS

(71) Applicant: Affinity Tool Works, LLC, Troy, MI (US)

(72) Inventors: Mike Ursell, Bloomfield Hills, MI (US); Kenneth Neilson, Troy, MI (US)

(73) Assignee: AFFINITY TOOL WORKS, LLC, Troy, MI (US)

( * ) Notice: Subject to any disclaimer, the term of this patent is extended or adjusted under 35 U.S.C. 154(b) by 255 days.

(21) Appl. No.: 15/636,443

(22) Filed: Jun. 28, 2017

(65) Prior Publication Data

US 2018/0001467 A1 Jan. 4, 2018

Related U.S. Application Data

(60) Provisional application No. 62/355,896, filed on Jun. 29, 2016.

(51) Int. Cl.
*B25H 1/06* (2006.01)

(52) U.S. Cl.
CPC ..... *B25H 1/06* (2013.01)

(58) Field of Classification Search
CPC ..... B25H 1/06
USPC ..... 182/153, 155
See application file for complete search history.

(56) References Cited

U.S. PATENT DOCUMENTS

| | | | | |
|---|---|---|---|---|
| 1,476,855 | A | 12/1923 | Topp | |
| 3,282,379 | A * | 11/1966 | Jones | B25H 1/06 182/155 |
| 4,640,386 | A | 2/1987 | Hall | |
| 6,681,895 | B2 * | 1/2004 | Virtue | B25H 1/06 182/153 |
| 2004/0238280 | A1 * | 12/2004 | Gibson | E04G 1/28 182/153 |
| 2010/0288585 | A1 * | 11/2010 | Katz | B25H 1/04 182/155 |
| 2017/0106527 | A1 * | 4/2017 | Birnbaum | B25H 1/0042 |

FOREIGN PATENT DOCUMENTS

| | | | |
|---|---|---|---|
| EP | 2251155 | A1 | 11/2010 |
| GB | 2217194 | A | 10/1989 |
| WO | 02055270 | A1 | 7/2002 |

* cited by examiner

*Primary Examiner* — Alvin C Chin-Shue
(74) *Attorney, Agent, or Firm* — William H. Honaker; Dickinson Wrigt PLLC

(57) ABSTRACT

A sawhorse having quick release deployable supports. The sawhorse includes a stretcher body having deployable supports pivotally mounted to the stretcher body. The deployable supports pivot with respect to the stretcher body from a storage position wherein the first and second supports are generally parallel to the stretcher body and a deployed position wherein the first and second supports are generally perpendicular to the stretcher body. A single lock mechanism locks the first and second deployable supports in the storage position and releases the deployable supports to the deployed position. Either the first or second deployable supports can be arbitrarily pivoted from the deployed to the storage position, with the other deployable support being pivoted from the deployed to the storage position.

10 Claims, 6 Drawing Sheets

SAW HORSE HAVING QUICK RELEASE DEPLOYABLE SUPPORTS

RELATED APPLICATIONS

This application claims the benefit of U.S. Provisional Application No. 62/355,896 filed on Jun. 29, 2016.

STATEMENT REGARDING FEDERALLY SPONSORED RESEARCH

NONE.

TECHNICAL FIELD

This invention generally relates to sawhorses and more particularly to portable sawhorses.

BACKGROUND OF THE INVENTION

Saw horses having a stretcher supported by a pair of v-shaped legs at each end are well known. Typically, the legs of these saw horses are fixed to the stretcher. Although they are portable, they are not easily portable and are difficult to store, since they take up a fair amount of room.

In an attempt to increase portability and storage, some sawhorses have removable legs. These sawhorses typically have two brackets; each of which is fixed to a pair of support legs. The top of the bracket is configured to receive the stretcher. The top of each bracket has a slot into which the stretcher can be inserted. When the saw horse is transported or stored, the stretcher is removed. In some saw horses, the bracket is hinged so that the legs can be folded together to make them more compact.

Although an improvement over conventional sawhorses, this type of saw horse has its drawbacks. Although arguably more portable than a conventional saw horse, the need to transport and store three separate pieces is not convenient. Additionally, the need to assemble and disassemble the sawhorses is time-consuming and inconvenient.

A further attempt to make conventional sawhorses portable and storable, includes sawhorses that have folding legs. These sawhorses typically have legs which are on a pivot that allows the legs to be folded adjacent the stretcher. Typically, these are manually folding legs and require one specific leg to be folded before the other leg in order to properly be received within or adjacent the stretcher.

What is needed is a saw horse that is conveniently portable and storable, a sawhorse that can be quickly opened or collapsed with minimal effort. One that is fast and compact. A saw horse that can be opened by pressing a trigger and collapsed by engaging releases to fold the legs into a stored position.

SUMMARY OF THE INVENTION

In general terms, this invention provides a sawhorse having a quick release to deploy the supports. The sawhorse includes a stretcher body having first and second opposed free ends. First and second deployable supports are pivotally mounted adjacent the first and second opposed free ends. The deployable supports pivot with respect to the stretcher body from a storage position wherein the first and second supports are generally parallel to the stretcher body and a deployed position wherein the first and second supports are generally perpendicular to the stretcher body.

A single lock mechanism locks the first and second deployable supports in the storage position and releases the deployable supports to the deployed position. Either the first or second deployable supports can be arbitrarily pivoted from the deployed to the storage position, with the other deployable support being pivoted from the deployed to the storage position.

Either the first or second support can be initially pivoted toward the storage position. Afterward, the other support can be pivoted toward the storage position with the lock locking both the first and second supports in the storage position. The ability to pivot either leg to the stored position results in a very user friendly saw horse. The user doesn't need to be concerned with which support to collapse first, either will work.

In the disclosed embodiment, the first and second supports each have two legs. The two legs each have a proximal end adjacent the stretcher body and a distal end. The two legs are pivotally connected to one another to move between an open position and a closed position. The legs are adjacent to one another in the closed position and the distal ends of the two legs form a generally V-shape in the open position. The closed position corresponds to the storage position and the open position corresponds to the deployed position.

The sawhorse of the present invention includes a wedge mounted to the stretcher body to engage the proximal ends of the two legs to retain the legs in the deployed position. The wedge adds stability to the sawhorse and allows the sawhorse to support additional loads.

The first and second deployable supports each have a latch for latching the supports in the deployed position. The support has a bar or pin and that engages a release handle mounted to the stretcher body. The release handle can be engaged to release the support.

In the disclosed embodiment, the single lock mechanism includes two spaced fingers, with a protrusion that engages the supports locking both the first and second supports in the storage position. The single lock mechanism includes a trigger to release the deployable supports to the deployed position. The trigger includes a control to release the spaced fingers and disengage the supports to release the supports to pivot to the deployed position. The finger includes a cam surface, the control engages the cam surface to remove the protrusion from the supports.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
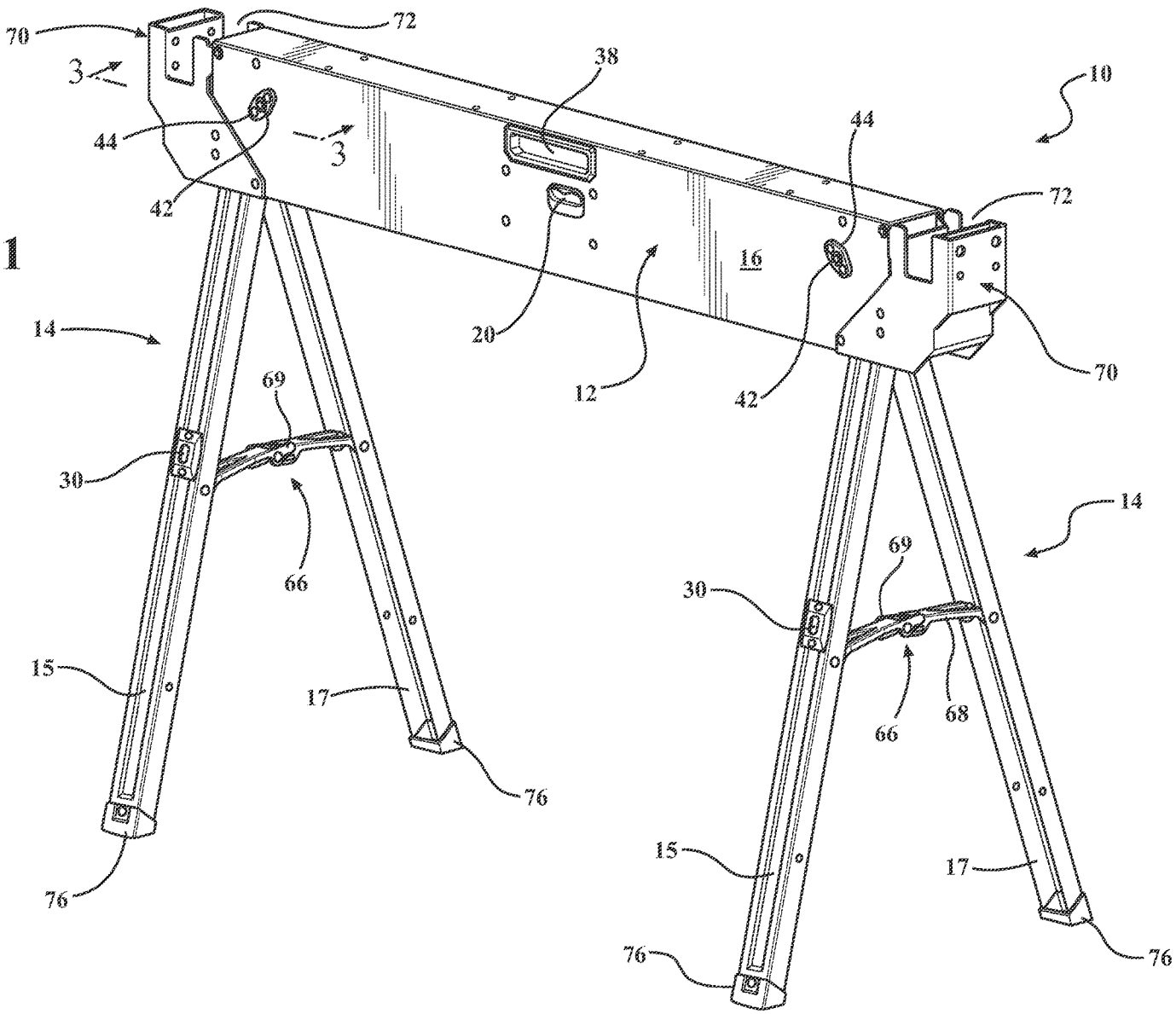
FIG. 1 is a perspective view of the saw horse of the present invention in the deployed or open position.
Figure 2:
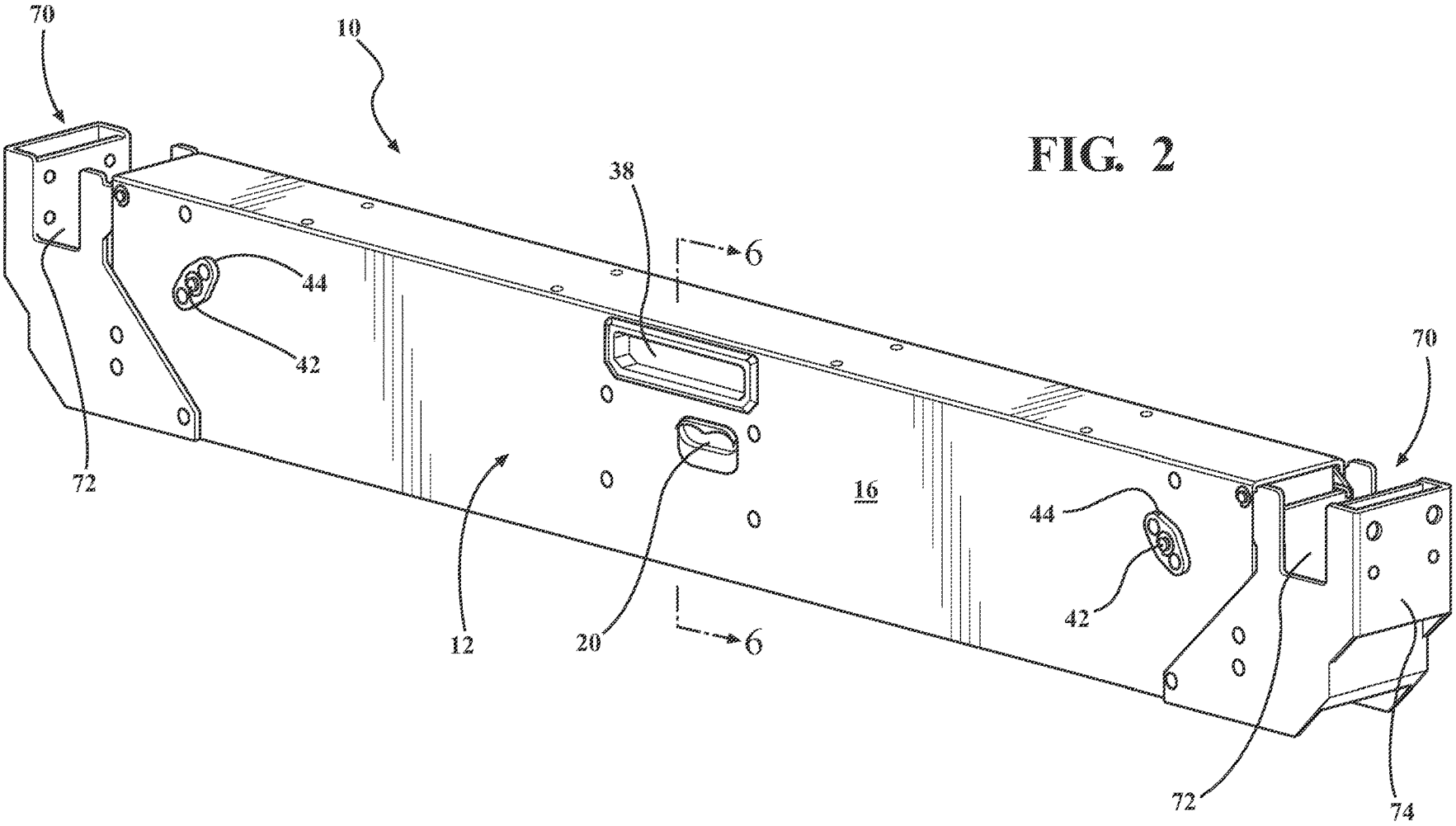
FIG. 2 is a perspective view of the saw horse of the present invention in the collapsed or closed position.
Figure 4:
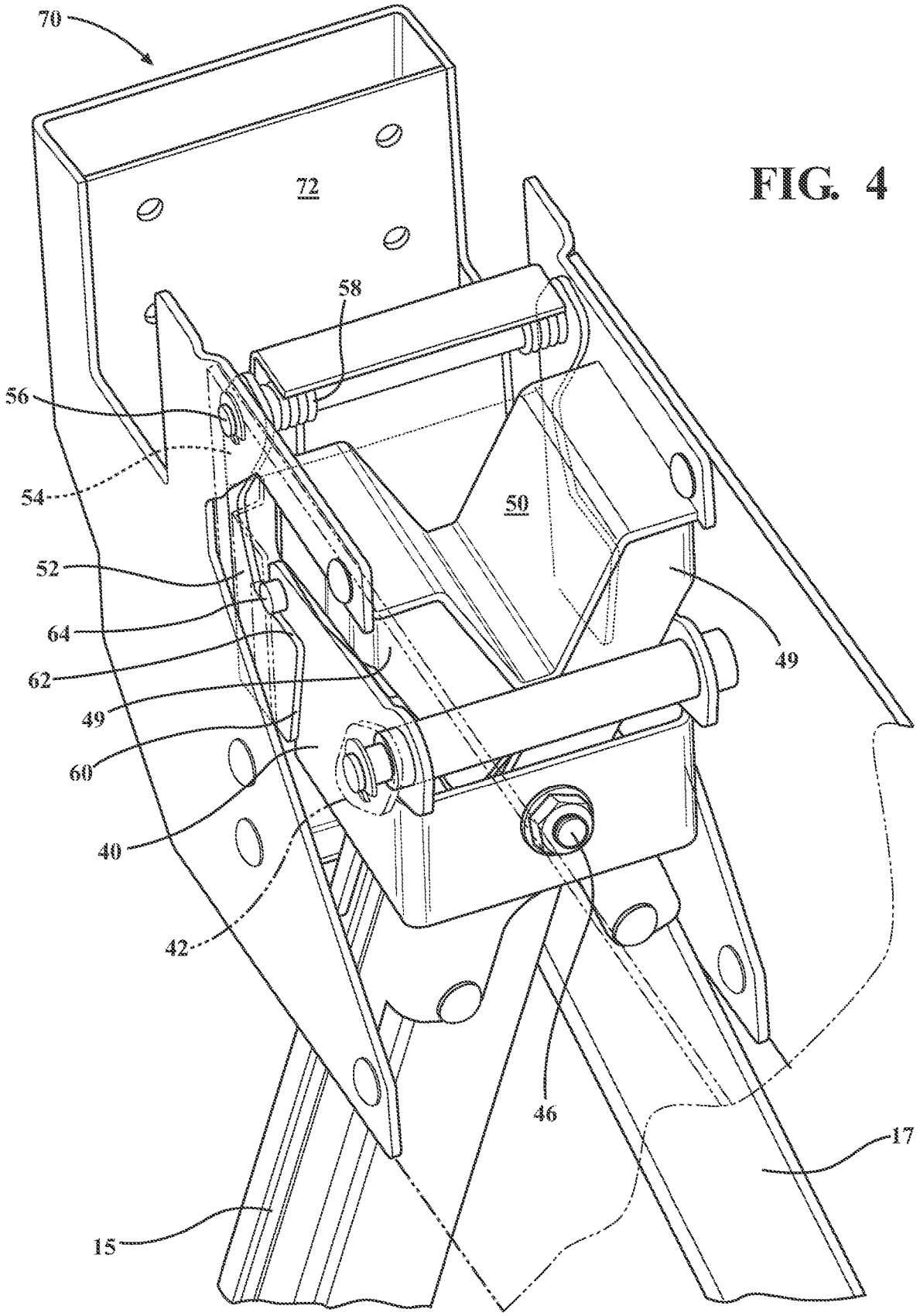
FIG. 4 is a partial perspective view of the saw horse of the present invention with the stretcher illustrated in phantom lines.
Figure 5:
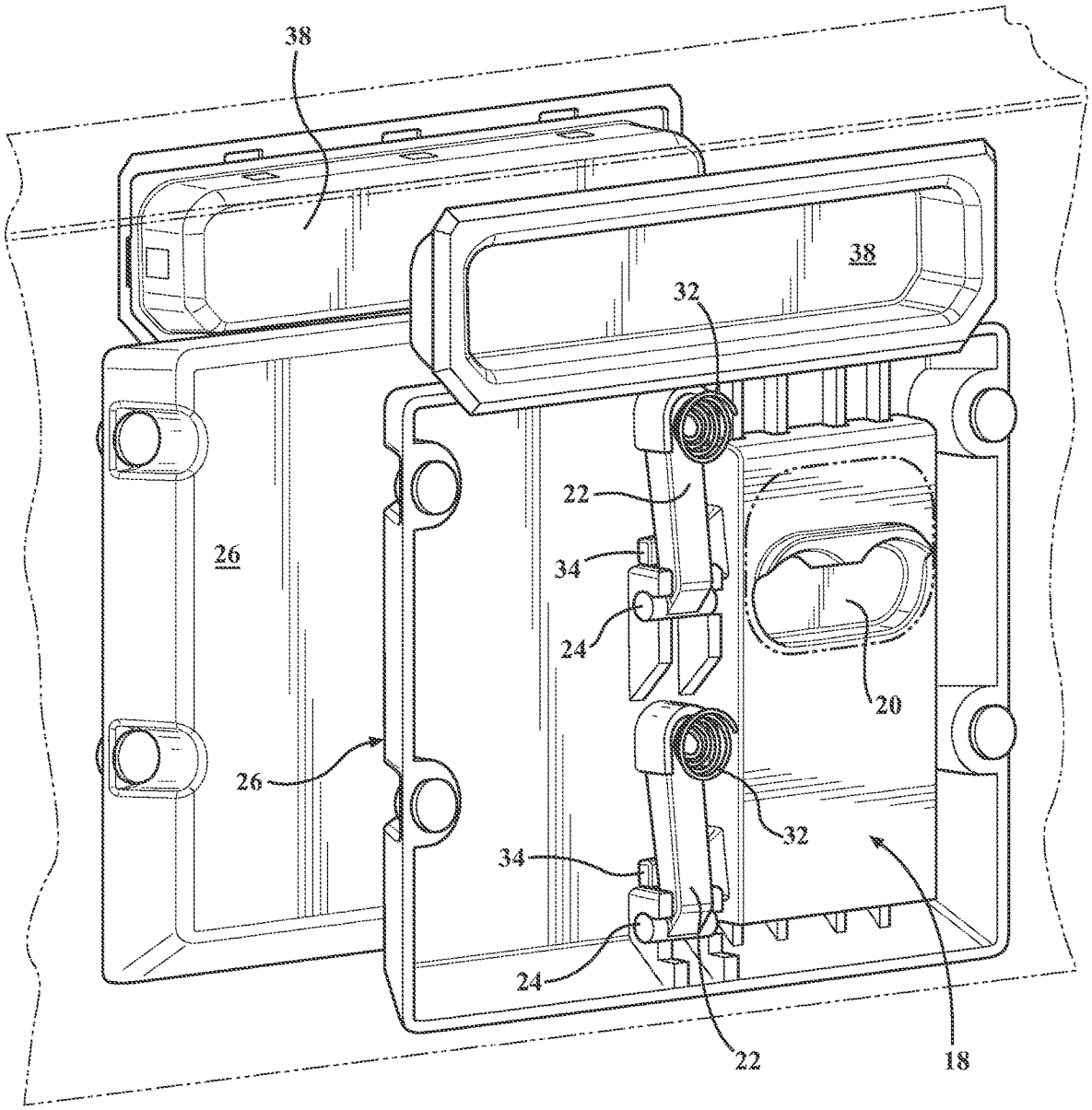
FIG. 5 is a partial perspective view of the single locking mechanism of the present invention with the stretcher illustrated in phantom lines.
Figure 6:
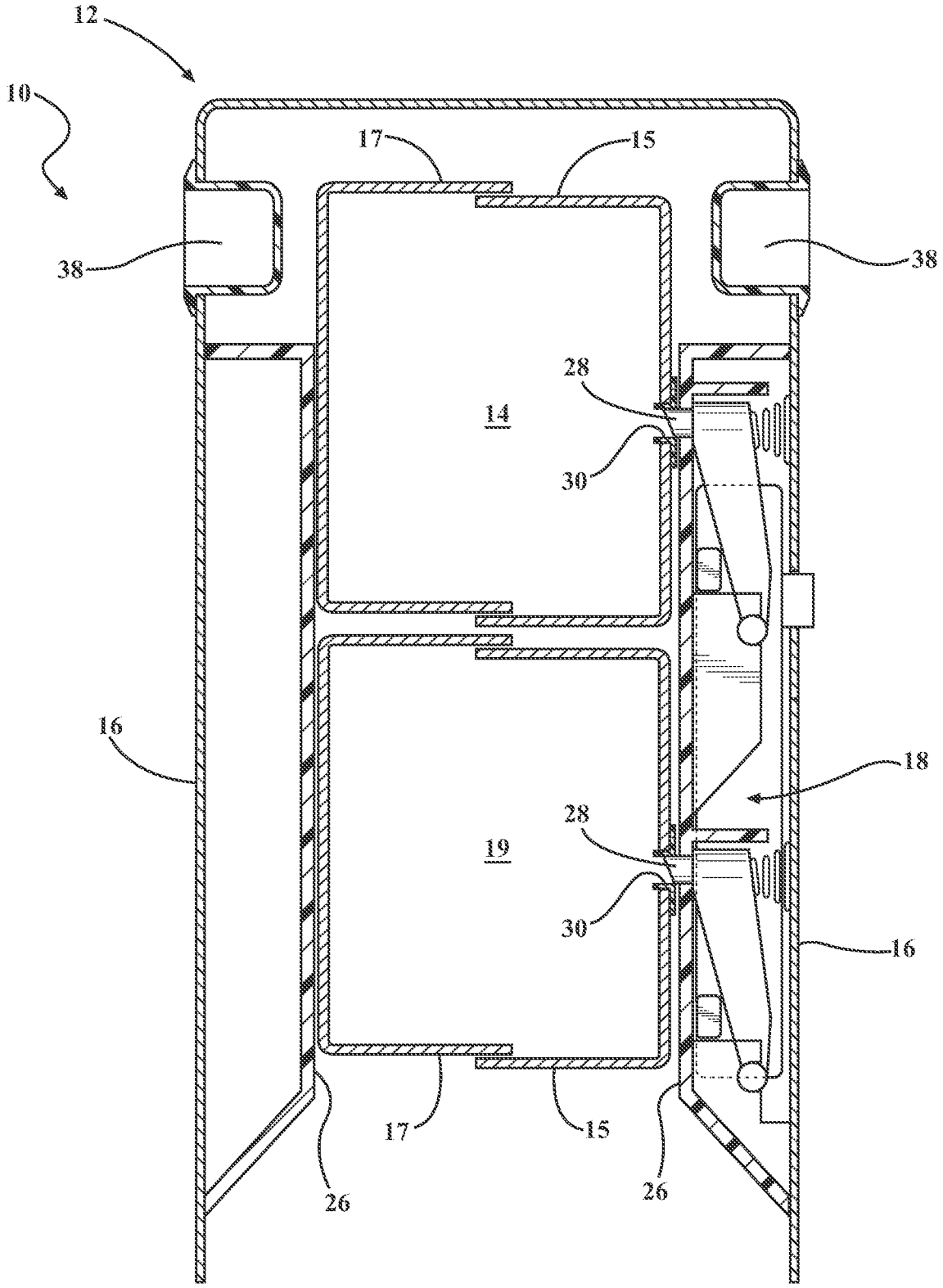
FIG. 6 is a cutaway view of taken along line 6-6 of FIG. 2.

The sawhorse of the present invention is generally shown at 10 in FIGS. 1 through 6. The sawhorse has a top rail or stretcher body 12 which is supported upon supports 14, which in the disclosed embodiment are defined by legs 15 and 17. Supports 14 can be collapsed and extended or deployed with respect to the stretcher body 12. As shown in FIGS. 2 and 6, the supports 14 can be collapsed into a cavity 19 formed by sidewalls 16. As illustrated in FIG. 1, the supports 14 are extended or deployed with respect to the stretcher body 12 to the support position.

In the collapsed position, the supports 14 are locked within the cavity 15 by a single lock mechanism 18, see FIGS. 5 and 6. The single lock mechanism 18 is controlled by a trigger mechanism 20. By engaging trigger mechanism 20, the single lock mechanism 18 is released to allow the legs 15 and 17 to extend to the deployed position. In the disclosed embodiment, the legs 15 and 17 pivot or rotate with respect to the stretcher body 12 from the collapsed position, see FIG. 2, to the extended or deployed position, see FIG. 1. Further, in the disclosed embodiment, the supports 14 rotate to the extended position by gravity. However, it will be appreciated by those of ordinary skill in the art that the supports 14 could be biased to the extended position by for example the use of springs.

The lock mechanism 18 includes two spaced fingers 22. In the illustrated embodiment, the fingers 22 are pivotally mounted through pivot pins 24 to a housing 26. Each of the fingers 22 have a protrusion 28, see FIG. 6, that engages the supports 14 locking both the first and second supports 14 in the storage position. Each of the legs 15 have a receiver 30 for receipt of the protrusion 28. In FIG. 6, the supports 14 are illustrated with the legs 15 engaged by the protrusion 28. In the disclosed embodiment, the fingers 22 are biased to the locking position by springs 32.

The lock mechanism 18 includes trigger 20 to release the deployable supports 14 to the deployed position. The trigger 20 includes a control 34, which as illustrated are two small pins, to move the spaced fingers 22 against the bias of springs 32 to disengage the protrusions 28 from the receivers 30 and deploy the legs 15 and 17. As disclosed, the fingers 22 have an angled side or cam surface 36 that is engaged by the pins of the control 34 to raise them with respect to the housing 26 removing the protrusions 28 from the receivers 30.

As will be apparent, the single trigger 20 can be raised to disengage both protrusions 28 and release both supports 14. Additionally, the supports 14 can be arbitrarily pivoted to the storage or closed position and locked in place. The unique single lock mechanism 18 will lock either of the supports 14 first and then the other support 14 second. There is no requirement that either one of the supports 14 always be pivoted first.

As illustrated in FIGS. 5 and 6, a second housing 26 is provided. The first and second housing 26 act as guides to guide the supports 14 into the stretcher 12 and keep the supports 14 centered. As can be seen, the second housing 26 does not have the lock mechanism, as only one is needed.

To facilitate easy carrying of the saw horse 12, finger slots 38 are provided on both sides of the saw horse 10.

Figure 3:
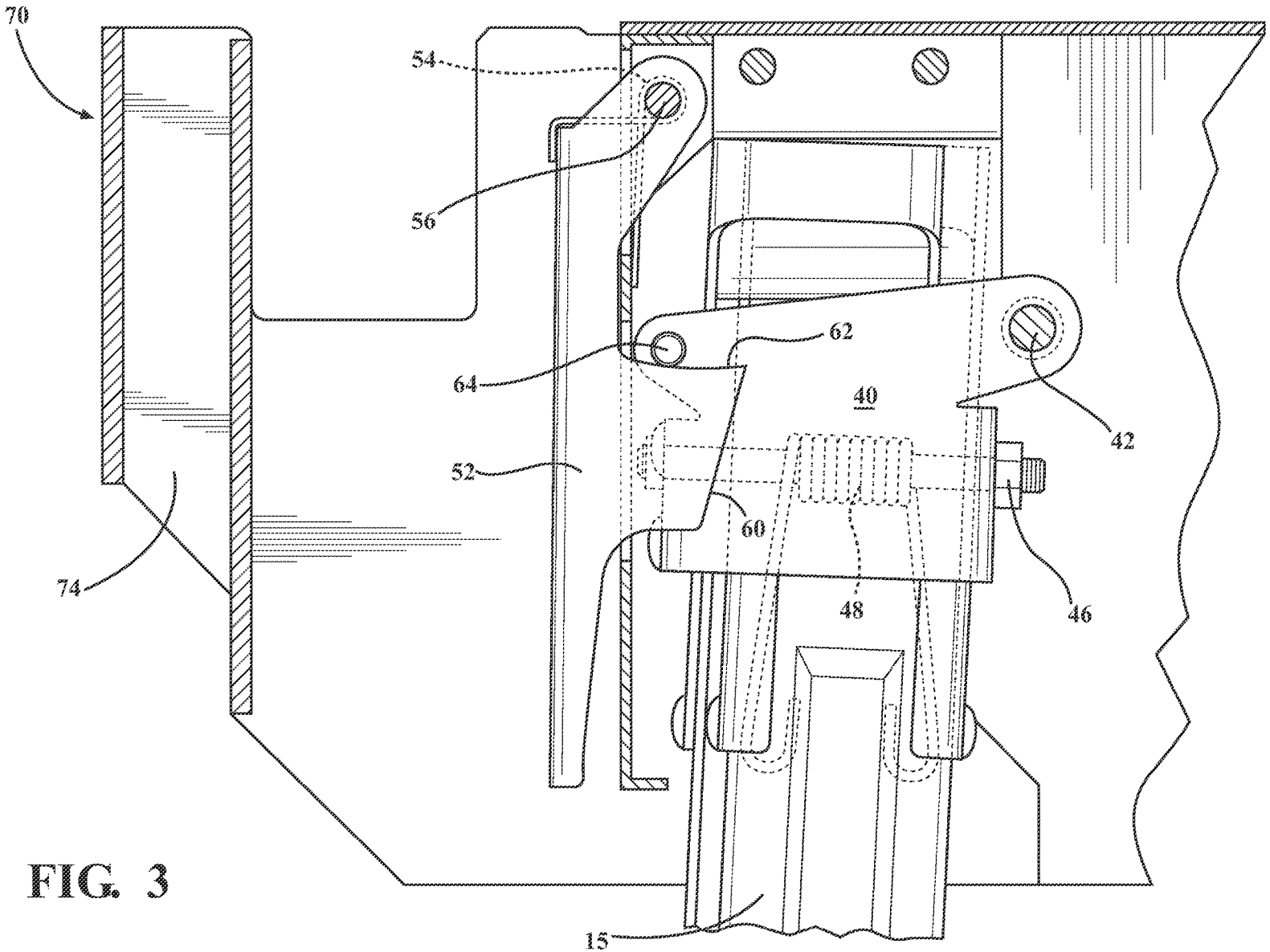
FIG. 3 is a cutaway view taken along line 3-3 in FIG. 1.

As best illustrated in FIGS. 3 and 4, there are two opposed leg brackets 40. Each leg bracket 40 operatively supports two support legs 15 and 17. The brackets 40 are pivotally mounted to the stretcher body 12, so that they can freely rotate with respect to stretcher body 12. The brackets 40 are mounted through first pivot pins 42 that are journaled in bearings 44 mounted to the sidewalls 16. Each leg 15 and 17 is pivotally mounted through second pivot pins 46 to the respective brackets 40. In the disclosed embodiment, the legs 15 and 17 are biased, for example by springs 48, to bias the pair of legs 15 and 17 away from one another to form the general V-shape of the legs in the extended position as illustrated in the various figures.

As illustrated in FIG. 4, the proximal ends 49 of each pair of legs 15 and 17 engage a wedge 50. The wedge maintains the proximal ends 49 and thereby the legs 15 and 17 in the general V-shape shown in FIG. 1. The wedge 50 also provides additional overall strength to the saw horse 10 by wedging the tops of the legs 15 and 17 between the sides of the wedge and the side walls 16.

A leg release lever or latch 52 normally locks the supports 14 in the extended position. See FIGS. 3 and 4. The latch 52 is illustrated as a plate with ears 54 for pivotally mounting the plate through a third pivot pin 56 to the sidewalls 16. As illustrated, the plate is biased inwardly in the direction of the bracket 40 by spring 58. The latch 52 also includes a cam surface 60 and a latching hook 62. The leg bracket 40 has a catch, such as pins or a bar 64 that engage the cam surface 60 and pivot the latch 52 allowing the catch 64 to be engaged by the hook 62.

As described above, in the disclosed embodiment, the supports 14 rotate with respect to the stretcher body 12 from the collapsed position to the extended position when the trigger 20 is released. When the bracket 40 engages latch 52 at the downward most position of the supports 14, the latch 52 locks the legs in the extended or deployed position. The supports 14 are released by urging the latch 52 against the bias of spring 58 which pivots the latch 52 about pivot pin 56 releasing the catch 64 from the hook 62.

With reference to FIG. 4, the legs 15 and 17 of supports 14 are pivotally mounted through second pivot pin 46 to the bracket 40. As the bracket 40 is pivoted with respect to the stretcher 12, the legs are biased by spring 48 between the open V-shape as illustrated in FIG. 1, or in the closed position with the legs adjacent one another as illustrated in FIGS. 2 and 6. When the legs 15 and 17 are rotated to the closed or storage position, the legs 15 and 17 engage the sidewalls 16 of the stretcher 12 to force them together. When the legs 15 and 17 are released by the lock mechanism 18, the spring 48 initially forces the legs 15 and 17 into the V-shape and then they are forced and held in the V-shape by the wedge 50.

Leg support brackets 66 are provided to add additional support to the legs 15 and 17. The brackets 66 have a first member 67 that is pivotally mounted to the leg 15 and to the second member 68 which in turn is pivotally mounted to the leg 17. A strengthening flange 69 engages a strengthening flange 69 protruding from the first and second members 67 and 68 to provide strength to the leg support brackets 66.

End caps 70 are provided on the opposed ends of the stretcher body 12. The end caps 32 have a lateral channel 72 for receipt of a 2×4. This allows either 2×4 to be extended between opposed sawhorses 10. Each end cap 70 also includes a handle 74 for carrying the sawhorse.

Stability feet 76 are mounted on the distal ends of each leg 15 and 17. In the disclosed embodiment, the stability feet 76 are pivotally mounted to the legs 15 and 17 so that they can move with respect to the legs 15 and 17 to provide stable support for the sawhorse 10. Additionally, the stability feet 76 can be pivoted with respect to legs 15 and 17 in the event the sawhorse 10 is placed on a surface that would be better suited for an exposed end of legs 15 and 17, such as a grassy surface. With for example a grassy surface, the exposed end of legs 15 and 17 could be pressed into the ground for better stability.

In use, the sawhorse 10 will typically have the support legs 14 in the collapsed position for storage. To use, the trigger 20 is depressed releasing the single lock mechanism 18 which allows the leg brackets 40 containing the legs 15 and 17 to pivot to the extended or deployed position. The legs 15 and 17 rotate with respect to the stretcher body 12 until they engage the wedge 50 and the latch 52 and are locked in place in the extended position. As the legs rotate to the locked extended position, each leg is biased about the pivot 46 to the generally V-shape illustrated in the figures.

When the sawhorse 10 is collapsed, the latch 52 is engaged and the support legs 14 are rotated with respect to stretcher body 12 into the cavity 15 and locked in place by the lock mechanism 18. As the legs 15 and 17 are rotated, the legs 15 and 17 engage the stretcher body 12 to pivot the legs 15 and 17 against the bias of spring 48 until the legs 15 and 17 are generally parallel and fully received in cavity 15 and locked in place by single lock mechanism 18.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A sawhorse having quick release deployable supports, said sawhorse comprising:

a stretcher body having first and second opposed free ends;

first and second deployable supports, said first deployable support pivotally mounted adjacent said first opposed end and said second deployable support pivotally mounted adjacent said second opposed end;

said deployable supports pivoting with respect to said stretcher body from a storage position wherein said first and second deployable supports are generally parallel to said stretcher body and a deployed position wherein said first and second deployable supports are generally perpendicular to said stretcher body;

a single lock mechanism for locking said first and second deployable supports in said storage position and releasing said deployable supports to said deployed position, either said first or second deployable supports being arbitrarily pivotable from said deployed to said storage position, with said other deployable support being pivotable from said deployed to said storage position, said single lock mechanism includes two spaced fingers, said fingers have a protrusion that engages said deployable supports locking both said first and second deployable supports in said storage position, said single lock mechanism includes two spaced fingers, said fingers have a protrusion that engages said deployable supports locking both said first and second deployable supports in said storage position, each of said fingers includes a cam surface, said control engages said cam surface to remove said protrusion from said deployable supports;

whereby said first and second deployable supports can be deployed by release of said single lock mechanism and either said first or second deployable support can be initially pivoted toward said storage position and then the other of said first and second deployable supports can be pivoted toward said storage position with said lock mechanism locking both said first and second deployable supports in said storage position.

2. The sawhorse of claim 1, wherein said first and second supports each have two legs, with said two legs each having a proximal end adjacent said stretcher body and a distal end, said two legs being pivotally connected to one another to move between an open position and a closed position, said legs being adjacent to one another in said closed position and said distal ends of said two legs forming a generally V-shape in said open position, said closed position corresponding to said storage position and said open position corresponding to said deployed position.

3. The sawhorse of claim 2, wherein said two legs are biased to said open position.

4. The sawhorse of claim 2, wherein said two legs are pivotally connected a spaced distance from said proximal end, said proximal ends of each of said two legs forming a generally V-shape in said open position.

5. The sawhorse of claim 1, wherein said stretcher body includes a top surface and sidewalls, said first and second deployable supports being concealed within said sidewalls when said first and second deployable supports are in said storage position.

6. The sawhorse of claim 4, wherein said stretcher body includes a wedge mounted to said stretcher body, said wedge engaging said proximal ends of said two legs to retain said legs in said deployed position.

7. The sawhorse of claim 1, wherein said first and second deployable supports each have a latch for latching said deployable supports in said deployed position.

8. The sawhorse of claim 7, wherein said deployable supports has a catch and said latch includes a release handle, said release handle has a cam surface and hook, said catch engaging said cam surface to raise said release handle and then engage said hook to latch said deployable supports in said deployed position.

9. The sawhorse of claim 7, wherein said release handle raises said hook to release said catch and permit said deployable supports to return to said stored position.

10. The sawhorse of claim 1, wherein said deployable supports include a recess to receive said protrusion.

* * * * *